United States Patent [19]

Undin

[11] Patent Number: 4,787,279

[45] Date of Patent: Nov. 29, 1988

[54] TOOL OF THE PLIERS-TYPE

[75] Inventor: Hans Undin, Akersberga, Sweden

[73] Assignee: C. A. Weidmuller GmbH & Co., Detmold, Fed. Rep. of Germany

[21] Appl. No.: 147,794

[22] Filed: Jan. 25, 1988

[30] Foreign Application Priority Data

Feb. 2, 1987 [SE] Sweden ..... 8700382

[51] Int. Cl.[4] ..... B25B 7/02

[52] U.S. Cl. ..... 81/313; 81/323; 81/338; 72/409; 74/17.5

[58] Field of Search ..... 72/409, 410; 74/17.5; 81/313, 315, 318, 323, 338

[56] References Cited

U.S. PATENT DOCUMENTS 2,777,345 1/1957 Reider ..... 81/313 X
3,039,337 6/1962 Stuart-Prince ..... 81/313 X
4,158,302 6/1979 O'Laughlin ..... 81/313 X
4,170,154 10/1979 Izraeli ..... 81/313
4,602,535 7/1986 Wiener et al. ..... 81/313

*Primary Examiner*—James G. Smith
*Attorney, Agent, or Firm*—Rogers & Killeen

[57] ABSTRACT

A tool with two elongated handles and two jaws operatively connected to the handles is provided with a mechanism for preventing premature opening of the handles and jaws. The mechanism comprises a pawl operating as a bistable rocker and engaging, with one or with two engagement means, an engagement member defined by two projections delimitating an operational area, or by at least one row of teeth with which each of the two engagement means is alternately engageable, so as to prevent premature interruption of the closing movement and preferably also of the reverse opening movement of the handles and of the jaws.

20 Claims, 7 Drawing Sheets

TOOL OF THE PLIERS-TYPE

SUMMARY OF THE INVENTION

The invention refers to a tool of the pliers-type having two elongated handles, two jaws operably connected to the handles for performing a closing movement and an opening movement, and a mechanism preventing premature interruption of said closing movement. The purpose of such a mechanism, also called stroke completion compelling mechanism, is to prevent opening of a pair of jaws before the operation to be performed on an inserted work piece has been duly terminated, i.e. the jaws have been fully compressed.

In U.S. Pat. No. 4,602,535 there is described such a mechanism comprising an engagement member which is pivotally connected to at least one of the handles, and a pawl member having an engagement part with a means of engagement with the said engagement member, and an actuating part where, in a first point of attachment, a spring means constantly actuates the pawl member so as to have it operate as a bistable rocker swingable between two opposite lateral positions.

It is an object of the present invention to improve the stroke completion compelling mechanism of the above kind so as to enable the engagement member to be rigidly connected to, and preferably be made integral with one of the handles, thus, among other things, eliminating the manufacturing step of pivotally connecting the engagement member with one or both handles when the tool is assembled. Another object of the invention is to establish, in a tool provided with said mechanism, an end stop means defining the maximally open condition. Still another object of the invention is to propose a locking mechanism of the above kind, with pivotal or with rigid attachment of the engagement member, wherein also the premature interruption of the said opening movement is prevented, i.e. where premature transition from any one of the said two movements to the other one is made impossible.

The reason why the jaws shall be compelled to completely finish also the opening movement is to bar the possibility of passing from the opening movement to the closing movement at a stage when the jaws are open only partially, but enough to accommodate a work piece of smaller dimensions, and then, after only partially compressing the work piece, to pass again to an incomplete opening movement etc., thus putting the stroke completion compelling mechanism totally out of play.

In accordance with the present invention, in a first aspect thereof, a tool of the pliers-type has two elongated handles, two jaws operably connected to the handles for performing a closing movement and an opening movement, and a mechanism preventing premature interruption of the said closing movement, said mechanism comprising an engagement member connected to at least one of said handles, and a pawl member pivotally mounted on a pivot pin which is connected with the first one of said handles. Said pawl member is constantly affected, in a first fixing point, by a spring means so as to operate as a bistable rocker swingable between two opposite lateral positions and comprises an engagement part with a means of engagement with said engagement member, and an actuating part on which said first fixing point is located. Said spring means is further anchored in a second fixing point connected to the said first handle, and said engagement part is defined by an elongated engagement arm extending, in a direction transverse to a line connecting said pivot pin and said first fixing point, between a first end attached to the actuating part, and a free second end. Said means of engagement is defined by a rearwardly pointing cog having an engagement edge, and located at said free end. A forwardly pointing second cog is provided at said first end and said engagement member is defined by a forward projection and a rearward projection which are rigidly connected to the second handle, point with their top portions toward the first handle, and are spaced one from another so as to define between them an operating area for the said engagement arm. Said rearward projection is at its top portion provided with a first tooth pointing toward the forward projection and having an engagement edge facing the said engagement edge of said first cog and being shaped for engagement therewith, and said top portion of said forward projection is defined by a point or tip alternately engageable with said engagement arm and said second cog to swing the pawl member from one side position to the other one, and vice versa.

As the engagement member is defined by two projections which are rigidly connected to the second handle, it easily can be made integral therewith, e.g. stamped together with the rest of the handle.

In order to achieve the above said stroke completion compelling function also in the opening movement, the rear projection is provided, spacedly from the top portion thereof, with at least one further tooth pointing toward the forward projection, and the forward projection is provided, spacedly from said top portion thereof, with a nose pointing toward the rear projection, and the engagement arm is at its free end provided with a third cog pointing toward the forward projection and engageable with said nose, the dimensions of said third cog and said nose being such as to allow the free end of pawl member to pass said nose without the pawl being swung into the reverse lateral position.

According to a second aspect of the invention, the stroke completion compelling function at the opening movement is achieved in a tool of the specified type, where the engagement means is defined by at least one row of teeth having an end stop at least at one end, a second end stop being provided adjacent the opposite end of the said at least one row of teeth, and where the engagement part of the pawl member has two spacedly disposed engagement means for alternate engagement, in dependence on the current lateral position of the pawl member, with said engagement member, each of the said engagement means allowing a movement of the engagement member relative the pawl member only in a direction opposite to the direction tolerated by the other engagement means, and each said engagement means being adapted to swing upon impact with one of said nd stops, the pawl member into its opposite lateral position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
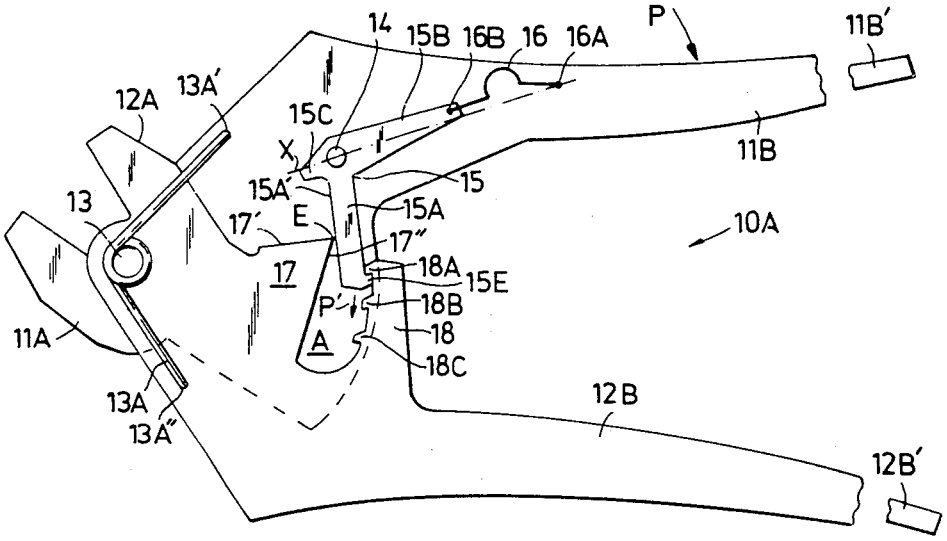
FIG. 1 is a side elevational view of a first embodiment of a tool according to the invention in maximally open condition.

Referring to the drawings, wherein like or analogous reference characters designate like parts throughout the several figures, a pair of pliers 10A according to FIG. 1 has two elongated handles 11B, 12B by which are driven two jaws 11A, 12A, each integral with one of the handles and defining a unit therewith.

In the present description and in the enclosed claims, "forward" or "forwardly" designates a position more close to, or a direction toward, the free ends of the jaws, and "rear" or "rearwardly" designates a position more close to, or a direction toward the free ends of the handles.

The two jaw-handle units 11A, 11B and 12A, 12B respectively are pivoted one to another by a pivot pin 13 and are held in maximally open condition by a spring 13A which is mounted on said pivot pin 13 and has two legs, the ends 13A' and 13A'' of which are each anchored in one of the said units.

In order that a closing movement in the sense of arrow P always is completely terminated, are the pliers 10A provided with a stroke completion compelling mechanism which now will be described in detail.

A pawl member 15 is pivotally mounted on the first handle 11B with the aid of another pivot pin 14, anchored in said handle. The pawl member 15 comprises an engagement part, defined by an elongated engagement arm 15A, and an actuating part, defined by an elongated actuating arm 15B. The actuating arm 16B extends rearwardly of the pivot pin 14.

Figure 7:
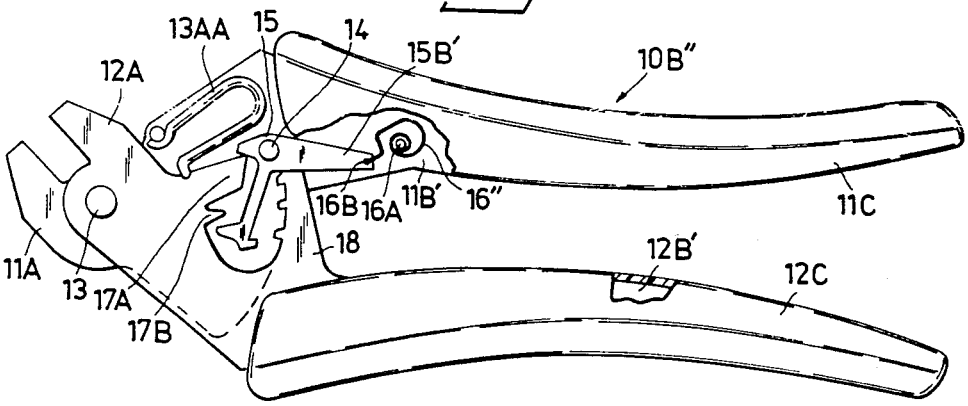
FIG. 7 is a side elevational view of a second alternative embodiment of the tool of FIG. 3 and 4 in maximally closed position.

A spring means, defined by an omega-shaped leaf spring 16 operating as a compression spring, is in a first point of attachment 16B connected to the actuating arm 15B at the rear end thereof, and is at a second point of attachment 16A anchored in the handle 11B, rearwardly of the pawl member 15. The first point of attachment may be defined e.g. by a short slot in the actuating arm 15B, and the second point of attachment 16A e.g. by a pin. The length of the spring 16 is, due to its omega-shape, greater than the spacement of said two points of attachment one from another. The spring means may be embodied also by a compression spring of some other shape, e.g. a zigzag shaped leaf spring, or a leaf spring shaped as shown in FIG. 7, as long as its length is greater than the spacement of its two points of attachment. Alternately, the spring means may be defined by an expansion spring, such as the helical spring shown in FIG. 5, on condition that the spacement of its two points of attachments is greater than the spacement of any one of them from the pivot pin of the pawl member.

The engagement arm 15A extends, generally in a direction transverse to a line X' (FIG. 2) connecting the pivot pin 14 and the first point of attachment 16B, between a first end, close to the actuating arm 15B and to the pivot pin 14, and a free second end.

The pawl member 15 is in a neutral central position when the two said fixing points of the spring 16, i.e. the slot 16B and the attachment pin 16A, and the pivot pin 14, lie on one straight line X, i.e. when the lines X and X' coincide. Such a position is shown in FIG. 5, while in FIG. 1 and 3 is shown a first swung-out lateral position, and in FIG. 2 and 4 an opposite second swung-out lateral position of the pawl member 15. Such an arrangement of the spring member 16 and the pawl member 15 results in the pawl member 15 operating as a bistable rocker.

A first, rearwardly pointing cog 15E is provided at the free end of the engagement arm 15A, and a second, forwardly pointing cog 15C is provided at the location where the engagement arm 15A is attached to the rest of the pawl member 15, i.e. essentially to the actuating arm 15B. The first cog 15E defines a means of engagement on the free end of the engagement part of the pawl member. The engagement arm 15A has a forward tracing edge 15A'.

Two projections 17 and 18, directed toward the first handle 11B and toward the pawl member 15 are rigidly connected to the second handle 12B and preferably, as illustrated , made in one piece with this second handle 12B. The forward projection 17 is limited by two edges 17', 17'' meeting in a sharp point E and it may be, as illustrated, partly integrated with the adjacent jaw 12A.

The two projections 17, 18 limit between them an operational area A for the pawl member 15 or, more specially, for the engagement arm 15A thereof. The rearward projection 18 is provided with three teeth 18A, 18B, 18C pointing forwardly, i.e. into said operational area A, tooth 18A being located at the top portion of the rearward projection 18. The teeth 18A, 18B, 18C have, as is more clearly evident from FIG. 6*a* and 6*b*, lower edges such as 18B', which slope upwardly toward the main body of the projection 18, and the first cog 15E has a corresponding upper edge 15'E' which is fit for engagement with the edges 18B' etc. by sloping downwardly toward the main body of the engagement arm 15A ("upper" and "lower" meaning closer to/more remote from the top of projections 17, 18, respectively).

Figure 6A:
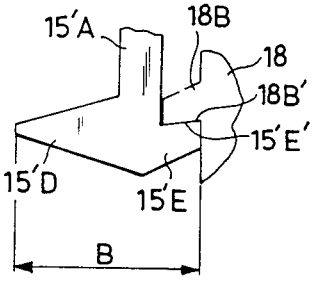
FIG. 6*a* and 6*b* show, at a larger scale and in two different positions, the free end of the pawl member in the tools according to FIG. 3 to 5.

The motion completion compelling mechanism operates as follows:

The jaws 11A, 12A and the handles 11B, 12B are in the position shown in FIG. 1 maximally opened. This position is defined by the first cog 15E engaging with the first tooth 18A in the same way as shown in FIG. 6*a* for the tooth 18B. The motion completion compelling mechanism operates thus also as a stop means for the maximally open position of the tool, because the first handle 11B can now be moved only in the sense of arrow P, and not in the reverse sense.

Figure 6B:
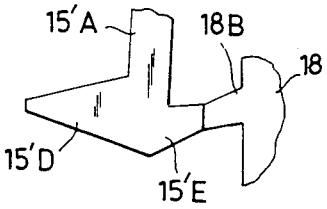

The constituent parts 15 to 18 of the mechanism are so dimensioned and located one relative another that the pawl member 15 is in its first lateral position (in which the first fixing point 16B lies spaced from, in FIG. 1 above, the line X) not only when the first cog 15E meshes with one of the teeth 18A to 18C, but also when this cog 15E is passing such a tooth, as shown in FIG. 6*b*. The spring 16 pushes the pawl member 15, in this first lateral position constantly against the rearward projection 18, also when the first cog 15E is passing anyone of the teeth 18A to 18C.

Upon operating the first handle 11B, the first cog 15E passes tooth 18B and meshes therewith, and then passes the tooth 18C and meshes therewith, without at any time allowing the pawl member 15 to be moved any substantial length against the sense of arrow P.

The upper edges of the teeth 18B and 18C slope upwardly toward the main body of the rearward projection 18, and in a greater degree than what the lower edges such as 18B', do. The lower edge of the first cog 15E slopes downwardly toward the main body of the engagement arm 15A so as to match the slope of the said upper edges. Thus, upon pushing the pawl member 15 downwardly, said upper and lower edges co-operate, but only as long as they are in contact one with another to swing the engagement arm 15A laterally.

Figure 2:
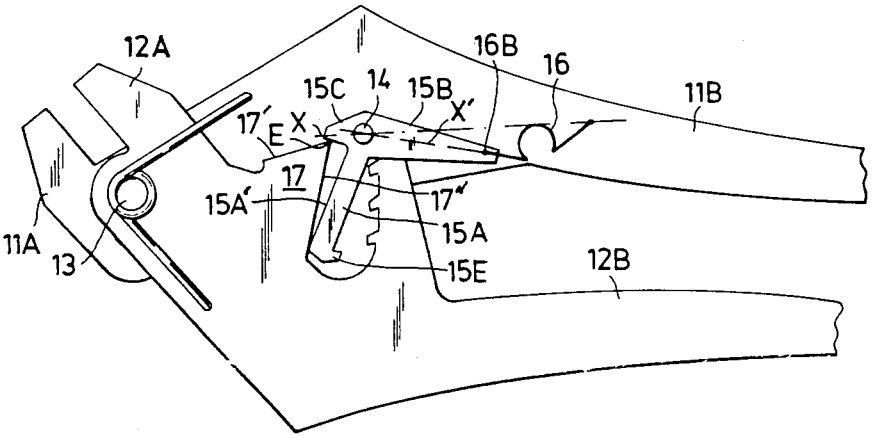
FIG. 2 is a side elevational view of the tool of FIG. 1 in maximally closed condition.
Figure 3:
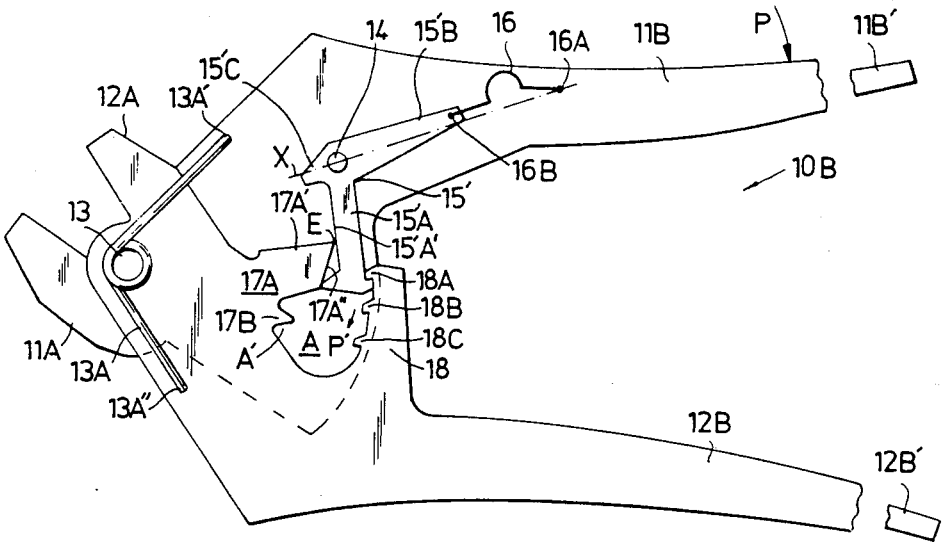
FIG. 3 is a side elevational view of a second embodiment of the tool according to the invention in maximally open condition.

After the first cog 15E has reached a position behind the tooth 18C, further movement of the first handle 11B in the sense of arrow P, and of the pawl member 15 in the sense of arrow P', brings the second cog 15C to hit the sharp point E, as shown in FIG. 2. By this impact, the pawl member 15 is swung through the neutral position into the opposite second lateral position (in which the first fixing point 16B again lies spaced from the line X, but now on the reverse side thereof, in FIG. 2 under this line).

In this second lateral position, the first cog 15E is free of the teeth 18A to 18C, so that the first handle 11B, and the jaw 11A, may be swung around the pin 13 against the sense of arrow P, i.e. the tool may be opened. However, during this opening movement, the sharp point E glides along the tracing edge 15A' of the engagement arm 15A until it in a selected position, defined by the lateral location of the sharp point E, swings the engagement arm 15A back into the first lateral position, as shown in FIG. 1. It will be realised that the forward projection 17, and specifically the sharp point E thereof, in engaging either the second cog 15C, or the tracing edge 15A', fills the function of both end stop means in the alternative embodiment of the invention described bellow.

The position in which the second cog 15C hits the sharp point E defines the final position of the closing movement of the jaws 11A, 11B. This position is selected so, that the jaws 11A, 12A lie then, e.g. thanks to their geometrical relation to the handles 11B, 12B, at a selected mutual spacement, which may be zero, or which may have any other desired value, e.g. as shown in FIG. 2.

Figure 4:
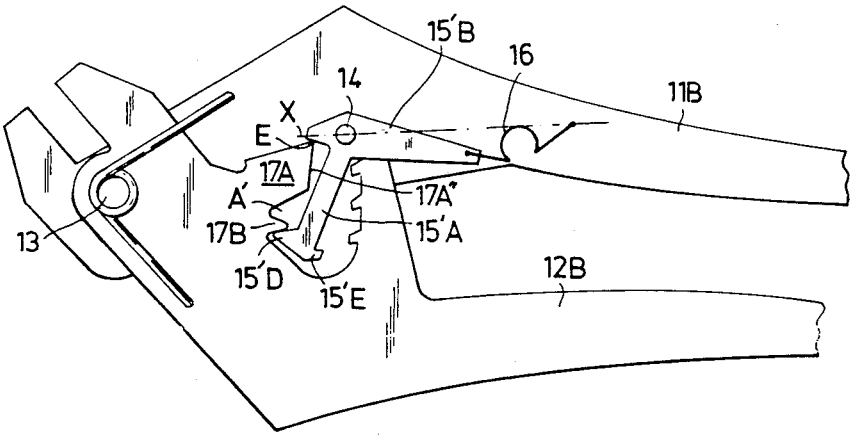
FIG. 4 is a side elevational view of the tool of FIG. 3 in maximally closed condition.
Figure 5:
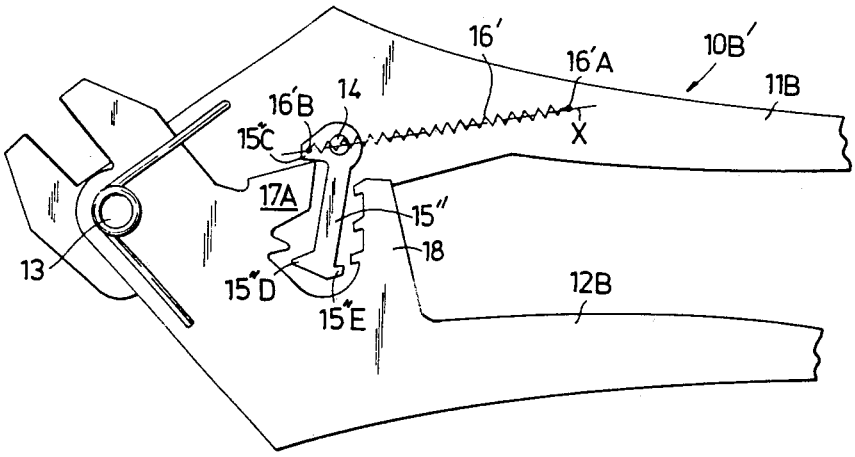
FIG. 5 is a side elevational view of a first alternative embodiment of the tool of FIG. 3 and 4 in maximally closed condition.

The tool 10B of FIG. 3 and 4 differs from the tool 10A in that that the engagement arm 15'A of the pawl member 15' carries at its free end a third cog 15'D located opposite the first cog 15'E and extending forwardly, and that the forward projection 17A is at its edge 17A", turned toward the operational area A, spacedly from the sharp point E provided with a recess A' with a nose 17B projecting in the middle of the recess.

The upper edge of the third cog 15'D slopes upwardly toward the main body of the engagement arm 15A, and the lower edge of the nose 17B slopes, correspondingly, downwardly toward the main body of the forward projection 17A so that, when the pawl member 15' is moved against the sense of arrow P, the third cog 15'D may glide along the nose 17B in analogy to the first cog 15'E moving along the teeth 18B and 18C when the pawl member 15 is moved in the sense of arrow P. And also in analogy thereto, the dimensions of the nose 17B and of the third cog 15'D are selected so that the pawl member 15' is not swung into its reverse lateral position when the tip of the third cog 15'D passes the tip of the nose 17B. Such reversion takes place first upon contact of the third cog 15D with the edge 17A" of the forward projection 17A.

The mechanism of FIG. 3 and 4 operates essentially in the same manner as described in connection with FIG. 1 and 2. As the parts 15'D and 17B can glide one along the other, the pawl member 15 may be freely moved against the sense of arrow P' because the operational area A, more precisely A and A', is wide enough to prevent meshing of the first cog 15'E with the teeth 18B and 18C even when the tips of the third cog 15'D and of the nose 17B are passing one another.

It will be appreciated that in the tool 10B the end stop function in the maximally opened position results also from the circumstance that the distance B (FIG. 6*a*) is greater than the shortest distance between the edge 17A" and the tooth 18A, as seen in FIG. 3.

The third cog 15'D and the nose 17B increase the reliability of the device, for once by creating the above mentioned longer distance B, but mainly because they securely prevent the introductorily mentioned possibility of prematurely interrupting an opening movement. In this connection shall also be mentioned that the second tooth 18B on the rearward projection 18 has no function in affecting the pawl member 15, its purpose being to prevent the tool to be partially opened when the first cog 15E or 15'E moves from the position behind the first tooth 18A (FIGS. 1 and 3) into the position behind the third tooth 18C (FIGS. 1 and 3). To the same purpose are also the gullets between the teeth 18A, 18B and 18C respectively dimensioned so as to not significantly exceed the corresponding dimension of the first cog 15E or 15'E.

The tool 10B' of FIG. 5 differs from the tool 10B in that that the leaf spring 16 is replaced by a helical spring 16' which has its first fixing point on the pawl member 15", defined by an attachment pin located on the second cog 15"C, i.e. beyond the pivot pin 14 relative to the second fixing point 16'A. The pivot pin 14 terminates flush with the surface of the pawl member 15", and the attachment pin 16'B projects therefrom. The length of the spring 16' is greater than the distance of any of its fixing points 16'A, 16'B from the pivot pin 14. A separate actuating arm, such as arm 15B in FIGS. 1 to 4, is not necessary, as the second cog 15"C fills the function of the actuating part of the pawl member 15" (and may to this purpose possibly be made somewhat longer).

The pawl member 15" is in FIG. 5 shown in its neutral central position in which the two fixing points 16'A, 16'B and the pivot pin 14 lie on the straight line X. The tool 10B" of FIG. 7 differs from the tool 10B particularly in the different shape of the two springs 16" and 13AA, and by the handles 11B', 12B' being provided with plastic covers 11C, 12C. The spring 13AA is a U-shaped leaf spring operating between the forward projection and the body of the tool.

Figure 8:
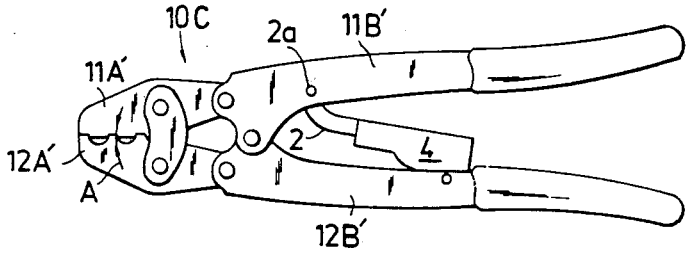
FIG. 8 is a side elevational view of a third embodiment of the tool according to the invention in maximally closed condition.

The tool 10C of FIG. 8 is a pair of pliers for crimping electrical terminals and has two jaws 11A', 12A' movable toward one another and away one from another in the senses of the double arrow PP. The jaws 11A' and 12A' are operatively connected to two handles 11B', 12B', between which handles a further embodiment of a motion completion compelling mechanism of the present invention, e.g. according to FIGS. 3 to 5, is mounted.

Said mechanism comprises in a per se known manner a housing 4 and a guiding rod or bar 2, bent at one end and at the other end slidably introduced into the housing. The guiding bar 2 and the housing 4 are pivotally attached to the handles 11B', 12B' with the aid of pivot pins 2*a* and 4*a*respectively. Bar 2 is provided with a rectilinear row of teeth 2' or 2" (FIGS. 10 to 12) at its end portion hidden in the housing 4.

Figure 9:
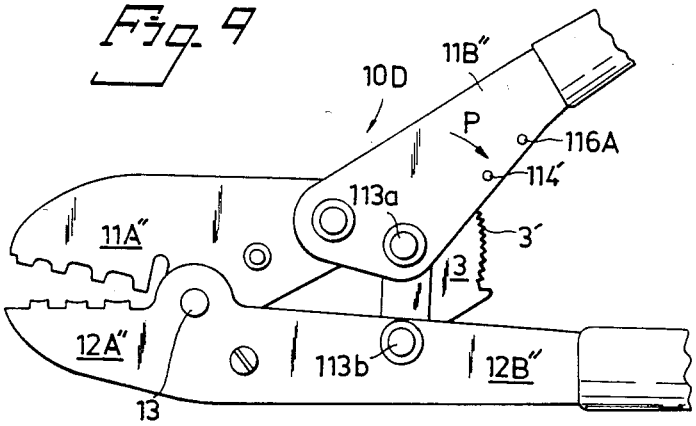
FIG. 9 is a side elevational view of a fourth embodiment of the tool according to the invention in maximally open condition.

Also the tool 10D of FIG. 9 is a pair of pliers for crimping electrical terminals, and has two jaws 11A", 12A" movable toward one another and away one from another. The jaws are operatively connected to two handles 11B" and 12B" movable toward one another and away one from another in the sense of double arrow P. The jaw 11A" is pivotally attached to the handle 11B", and the jaw 12A" is rigidly connected to the handle 12B".

Between the handles 11A" and 12B" there is mounted another embodiment of the motion completion compelling mechanism of the present invention, e.g. according to one of the FIGS. 14 to 17. Such a mechanism comprises a segment member 3 which is pivoted to both handles 11B", 12B" by means of pivot pins 113*a*, 114*a* and which carries an arcuate (circular) row of teeth 3' having its center of curvature in one of the said pivot pins (pivot pin 113*a* in FIG. 9). The two handles 11B", 12B" have a U-shaped cross-section, and the segment member 3 is located inside the handles. In one of the handles is further, with the aid of a pivot pin 114', pivotally mounted a pawl member 150 (FIG. 14) meshing with the row of teeth 3'. The row of teeth 3' is centered relative that one of the pivot pins 113*a*, 113*b* which is mounted in the handle in which also the pawl member is mounted. The features of the mechanisms of FIG. 8 and 9 mentioned so far are conventional, and are also known in connection with a pawl member operating as a bistable rocker (cfr. the above mentioned U.S. Pat. No. 4,602,535).

Figure 10:
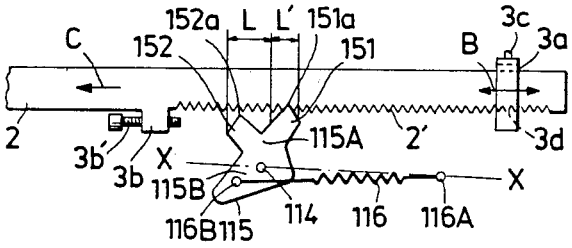
FIG. 10 shows a first embodiment of the stroke completion compelling mechanism in the tool of FIG. 8.

Turning now to FIG. 10, the guide bar 2 has at its right hand end, which is not seen in FIG. 8, where the tool 10C is shown in its closed position, a rectilinear row of teeth 2' defining the engagement member. The row of teeth 2' is limited at one end by a settable end stop defined by a setting screw 3*b*' mounted in a fixed block 3*b*, and at the other end by an end stop settable in the senses of arrow B and embodied by a rider 3*a*. The rider 3*a* is fixable with the aid of a short internal row of teeth 3*d*, meshing with the row of teeth 2', and a of pressure screw 3*c*.

On a pivot pin 114 which is anchored in the housing 4 (not shown in FIG. 8) is a pawl member 115 mounted which operates as a bistable rocker and which is constantly affected by a spring means defined by a helical spring 116 operating as an extension spring and anchored in a first fixing point (attachment pin) 116B on the pawl member 116, and in a second fixing point (also an attachment pin) 116A in the housing 4. For more detailed description, reference is made to the said U.S. Pat. No. 4,602,535.

The pawl member 116, which by the pivot pin 114, the housing 4, and the pivot pin 4*a* is connected with the handle 12B', comprises an actuating part 115B with the attachment pin 116B (in FIG. 10 the part bellow the straight line X connecting the pivot pin 114 and the attachment pin 116A), and an engagement part 115A (in FIG. 10 above the line X).

According to the present invention, the engagement part 115A comprises two means of engagement with the row of teeth 2', defined by two short engagement arms 151, 152, or, more precisely, by adjacent sharp corners 151*a*, 152*a* on the free ends of these arms, adapted to alternately engage the row o teeth 2'. Both arms 151, 152 with the corners 151*a*, 152*a* lie in the same plane (the drawing plane of FIG. 10) and the guide bar 2 with the row of teeth 2' has at least approximately the same thickness (dimension at right angles to the drawing plane) as the pawl member 115.

When the tool 10C is being opened, i.e. when the handles 11B', 12B' are moved apart, the guide bar 2 moves in the sense of arrow C relative to the housing 4. The engagement arm 151, meshing then with the row of teeth 2', "jumps" from one tooth to another, but prevents at the same time any movement of the guide bar 2 against the sense of arrow C. However, in the instant when the other engagement arm 152 hits the end stop 3*b*', the pawl member 115 is by this impact swung from its first lateral position, shown in FIG. 10, via the neutral central position (in which also the attachment pin 116B lies on the line X), into the reverse second lateral position, in which the engagement arm 152 meshes with the row of teeth 2', and the engagement arm 151 is disengaged therefrom. In this condition, only a movement of the guide bar 2 against the sense of arrow C is possible, the engagement arm 152 now "jumping" over the teeth and at the same time preventing a reverse movement.

In the instant when the engagement arm 151, now in lifted position, hits the end stop 3*a*, the pawl member 115 is swung back into the first lateral position shown in FIG. 10, and this process is repeated upon each impact. No reversion of a movement in any of the two directions is however possible intermediately the two end positions just described.

As the arrow C indicates the opening motion of the tool 10C, the end stop 3*a* is located at a first end of the row of teeth 2' corresponding to the maximally opened position, and the end stop 3b' is located at a second end of the row of teeth 2', corresponding to the maximally closed position (shown in FIG. 8) of the tool 10C.

In comparison with the motion completion compelling mechanism with a straight row of teeth according to U.S. Pat. No. 4,602,535, it will be observed that no side stop is needed in the present mechanism, the other engagement arm automatically performing this function, and further, that the row of teeth 2' has to be extended approximately by the distance L. The distance L' is the spacement between the two locations at which the pawl member of U.S. Pat. No. 4,602,535 hits the two end stops, and this spacement is in the present embodiment increased to L+L'.

Figure 11:
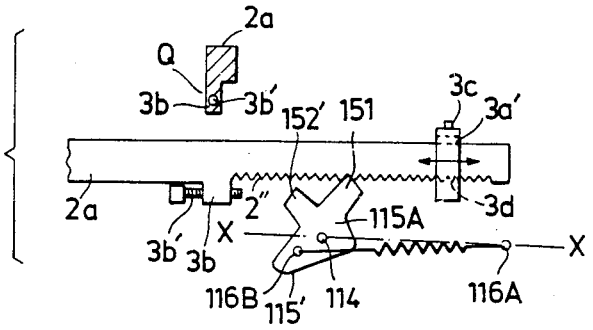
FIG. 11 shows a second embodiment of said mechanism in the tool of FIG. 8.
Figure 12:
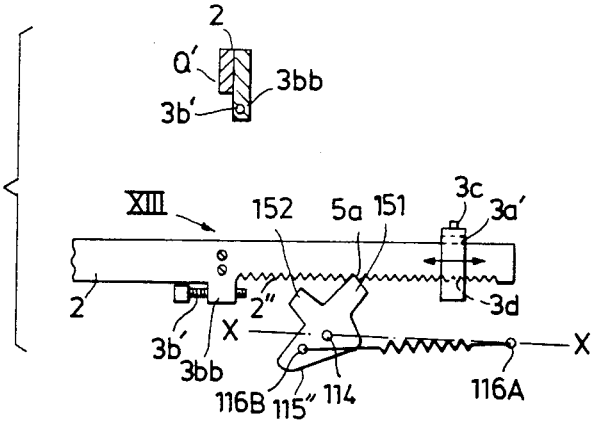
FIG. 12 shows a third embodiment of said mechanism in the tool of FIG. 8.

The need to extend the length of the row of teeth 2' is however eliminated in the embodiments of FIG. 11 and 12. The second engagement arm 152' of the pawl member 115' is shifted relative the first engagement arm 151 in the sense of the thickness dimension (i.e. at right angles to the drawing plane), e.g. by being bent out or, as illustrated, by being riveted to one face of the main body of the pawl member. The guide bar 2a, or at least its part carrying the row of teeth 2'', is thicker than either engagement arm 151, 152', and its thickness preferably corresponds to the joined thicknesses of both engagement arms.

Consequently, the engagement means at the free ends of the engagement arms are located and operate in different planes, each engagement arm 151, 152' having on the row of teeth 2'' its proper "path" adjacent to the path of the other engagement arm. To this purpose, the row of teeth has been made thick enough to enable engagement with both engagement means , but at least one of the ends stops, in FIG. 11 the end stop 3b, 3b', occupies only the space of one of these paths, as evident from the cross-section Q. The engagement arm 152' can thus freely pass alongside the end stop 3b, 3b', and reversion of the pawl member 115' takes place upon impact of the engagement arm 151 with the stop screw 3b'.

The pawl member 115' operates thus essentially in the same way as the pawl member according to the U.S. Pat. No. 4,602,535, however, with the important difference that after reversion the other engagement arm meshes with the row of teeth and prevents rearward movement (and also acts as a side stop).

It will be realized that the embodiment of FIG. 11 also can be obtained by fixing together two identical guide bars and pawl members (the pawl members in reversed position as illustrated), and at least one end having an end stop only on one of the guide bars.

Figure 13:
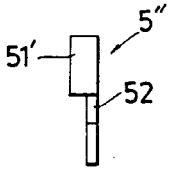
FIG. 13 is a view in the sense of arrow XIII in FIG. 12 of the pawl member in the mechanism of FIG. 12.

In the embodiment of FIG. 12 does the guide bar 2 not have increased thickness. The pawl member 115'' has one engagement arm, in FIG. 12 arm 151', thicker than the rest of the pawl member (approximately twice as thick), as evident from FIG. 13. The end stop block 3bb with the setting screw 3b' is shifted in the direction of the thickness dimension, in analogy to the one engagement arm in the embodiment of FIG. 11, as evident from the cross-section Q'. Block 3bb may be bent out of the plane of the guide bar 2 or, as illustrated, riveted to one lateral face of the guide bar 2. The thinner engagement arm 152 may thus freely pass along the block 3bb and the mechanism operates essentially in the same manner as the mechanism according to FIG. 11.

It is obvious that in the embodiments of FIGS. 11 and 12 one or both end stops also can be fixed, i.e. non settable.

The three alternatives just described, i.e. extending the row of teeth, or shifting one engagement arm or one end stop, are also applicable in mechanisms for tools according to FIG. 9 having arcuate rows of teeth, and as shown in FIGS. 14 to 17.

Figure 14:
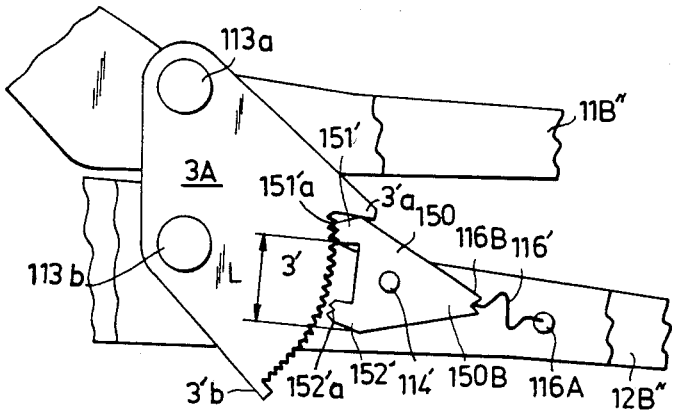
FIG. 14 shows a first embodiment of the stroke completion compelling mechanism in the tool of FIG. 9.

According to FIG. 14, a segment member 3A is provided with an arcuate row of teeth 3' defining the engagement member. The row of teeth 3' is at both its ends limited by a fixed end stop 3'a and 3'b respectively and is, out of the same reason as the rectilinear row teeth 2' of FIG. 10, somewhat longer than e.g. the corresponding row of teeth in FIG. 7 in U.S. Pat. No. 4,602,535. The distance L indicates approximately the said extension of the row of teeth 3'.

A pawl member 150 with an actuating part 150B is pivotally mounted in the handle 11B'' and has an engagement part 150A comprising two spaced, short engagement arms 151', 152' terminated at their free ends by short rows of teeth 151'a, 152'a meshing with the row of teeth 3' and defining means of engagement therewith.

The pawl member 150 is constantly affected by a zigzag shaped leaf spring 116' operating as a compression spring and which is in a first fixing point 116B, defined e.g. by a short slot, attached to the pawl member 150, and in a second fixing point 116, defined e.g. by an attachment pin, to the handle 12B''.

The pawl member 150 operates as a bistable rocker, and in FIG. 14 is illustrated the instant when the engagement arm 151' has hit the end stop 3'a and the pawl member 150 has been swung into the lateral position in which the rows of teeth 151'a and 3' mesh one with another and the row of teeth 152'a is disengaged.

Figure 15:
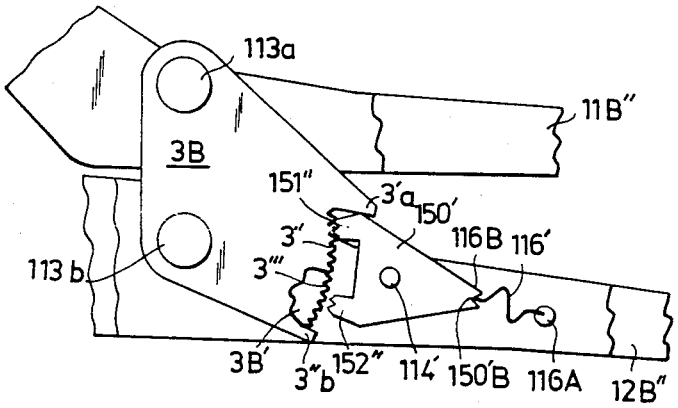
FIG. 15 shows a second embodiment of said mechanism in the tool of FIG. 9.

In the embodiment according to FIG. 15, the segment member 3B or, more specifically, the row of teeth 3'' thereon, may be made thicker than the engagement arms 151'', 152'' of the pawl member 150' (appr. double as thick), or two segment members 3b', 3B', each equally thick as an engagement arm 151'', 152'', can be mounted one alongside the other and riveted together e.g. by means of the pivot pins 113a, 113b.

One of the engagement arms of the engagement part 150'A is bent out of the plane of the main body of the pawl member 150'' (arm 152' in FIG. 15), so that each engagement arm 151'', 152'' follows its own path on the row or rows of teeth 3'', 3'''. At one end of the row or rows of teeth 3'', 3=is the respective end stop so thin that only one of the engagement arms 151'', 152'' can be hit by it, the other engagement arm having free passage past this end stop (in FIG. 15 the bent-out engagement arm 152'' may pass along the end stop 3''b). The row or rows of teeth 3'', 3''' need not to be extended in this case.

Figure 16:
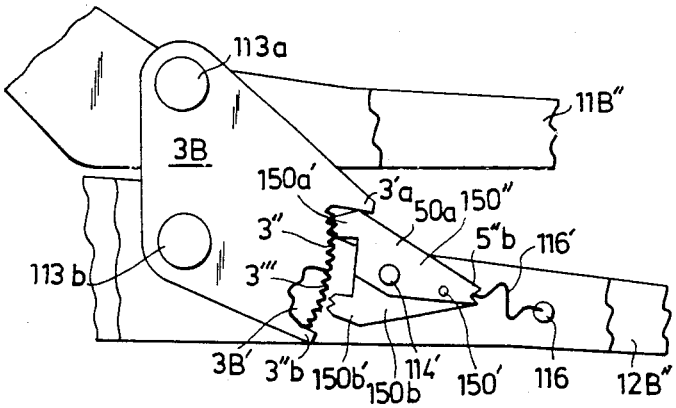
FIG. 16 shows a third embodiment of said mechanism in the tool of FIG. 9.

In the embodiment of FIG. 16 is the segment member 3B made in the same manner as according to FIG. 15, i.e. either thicker, or doubled. The pawl member 150'' consists of two identical pawls 150a and 150b, in reverse position rigidly affixed (pins 114' and 214) one to another. Each pawl 150a, 150b is provided with one engagement arm 150a', 150b' respectively. As each pawl 150a, 150b is made of a material with a certain thickness, and the pawls are mounted adjacently one another, their respective engagement arms 150a', 150b' lie in different planes and follow their own paths. At least one of the end stops 3'a, 3'b allows one of the said engagement arms to freely pass along (stop 3'b and arm 150b' in FIG. 16).

Figure 17:
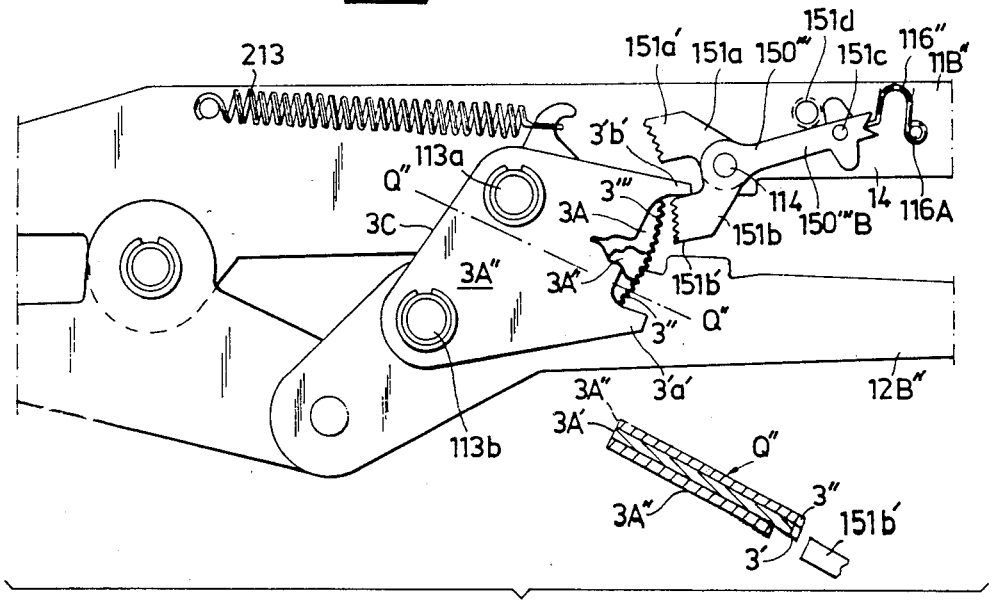
FIG. 17 shows, at a somewhat larger scale, a fourth embodiment of said mechanism in the tool of FIG. 9.

Essentially in the same manner is also the pawl member 150''' of FIG. 17 built up of two reversely mounted, identical pawls 151*a*, 151*b* rigidly connected one to another e.g. by pins 114' and 151*c*. The pawl member 150''' has an actuating part 150''' B and an engagement part 150'''A.

The segment member 3C can again be assembled from two thinner segments 3B, 3B', or it can be made as a single thicker segment. The row or rows of teeth 3'', 3''', however, are at neither end terminated by an end stop. Instead, a further segment element 3A'' is provided which has no row of teeth, but has two end stops 3'*a'* and 3'*b'* and is by means of e.g. the pins 113*a*, 113*b* rigidly attached to the other segment or segments carrying a row of teeth. The two end stops 3'*a'* and 3'*b'* lie in different planes; in FIG. 17 is end stop 3'*a'* bent so (under the plane of the drawing) as to lie in the plane of the engagement arm 151*a'*, but not to obstruct the path of the engagement arm 151*b'*. It will be appreciated that also two segment elements without a row of tooth, each carrying one end stop, may be used. The arrangement of the segment elements evident from the cross-section taken along the plane Q''—Q'' has the advantage that by replacing the segment element A'' by an other one with another spacement of the two end stops, different operational lengths of the row or rows of teeth may be readily obtained.

A side stop 151*d* eliminates the necessity to provide, as an extension of the row or rows of teeth, an inrun (possibly without teeth) to establish proper engagement between the one of the engagement arms of the said member and the segment member.

A tension spring means 213 operates between a projection on the segment member C and the body of the tool.

We claim:

1. A tool of the pliers-type, having two elongated handles; two jaws operably connected to the handles for performing a closing movement and an opening movement, and a mechanism preventing premature interruption of the said closing movement, said mechanism comprising an engagement member connected to at least one of said handles, and a pawl member pivotally mounted on a pivot pin which is connected with the first one of said handles, said pawl member being constantly affected, in a first fixing point, by a spring means so as to operate as a bistable rocker swingable between two opposite lateral positions, said pawl member comprising an engagement part with a means of engagement with said engagement member, and an actuating part on which said first fixing point is located, said spring means being further anchored in a second fixing point, connected to the said first handle, wherein said engagement part is defined by an elongated engagement arm extending, in a direction transverse to a line connecting said pivot pin and said first fixing point, between a first end attached to the actuating part, and free second end;

said means of engagement is defined by a rearwardly pointing cog, having an engagement edge, and located at said free end;

a forwardly pointing second cog is provided at said first end;

said engagement member is defined by a forward projection and a rearward projection which are rigidly connected to the second handle, point with their top portions toward the first handle, and are spaced one from another so as to define between them an operating area for the said engagement arm;

said rearward projection is at its top portion provided with a first tooth pointing toward the forward projection and having an engagement edge facing the said engagement edge of said first cog and being shaped for engagement therewith;

said top portion of said forward projection is defined by a point alternately engageable with said engagement arm and said second cog to swing the pawl member from one side position to the other one and vice versa.

2. The tool of claim 1, wherein the rearward projection is provided, spacedly from the top portion thereof, with at least one further tooth pointing toward the forward projection.

3. The tool of claim 2, wherein the lower edge of said at least one further tooth slopes upwardly toward the main body of the rearward projection, and the upper edge of the first cog correspondingly slopes downwardly toward the main body of the engagement part.

4. The tool of claim 3, wherein the upper edge of said at least one further tooth slopes upwardly toward the main body of the rearward projection more steeply than the lower edge of the tooth, and the lower edge of the first cog slopes downwardly toward the main body of the engagement arm in correspondence to the slope of said lower edge of the tooth.

5. The tool of claim 1, wherein the forward projection is provided, spacedly from said tip portion thereof, with a recess and a nose projecting therefrom toward the rearward projection, and the engagement arm is at its free end provided with a third cog pointing toward the forward projection and engageable with said nose, the dimensions of said third cog and said nose being so as to allow the free end of the pawl member to pass said nose without the pawl being swung into the reverse lateral position.

6. The tool of claim 1, wherein the actuating part is defined by an elongated actuating arm extending rearwardly of the pivot pin to a rear end, the first fixing point is located at said rear end, and the second fixing point is located on the same side of the pivot point as the first fixing point.

7. The tool of claim 6, wherein the first fixing point is defined by a slot at the rear end of the actuating arm.

8. The tool of claim 1, wherein said actuating part is defined by said second cog and said second fixing point is located on the reverse side of the pivot pin than where the first fixing point is located.

9. The tool of claim 1, wherein a biasing spring means operates between the first handle and the forward projection.

10. The tool of claim 1, wherein at least one of the forward and rear projections is made integral with the second handle.

11. A tool of the pliers-type, having two elongated handles, two jaws operably connected to the handles for executing a closing movement and an opening movement, and a mechanism preventing premature interruption of said closing movement, said mechanism comprising an engagement member connected to at least one of said handles, and a pawl member pivotally mounted on a pivot pin which is connected with the first one of said handles, said pawl member being constantly affected, in a first point of attachment, by a spring means so as to operate as a bistable rocker swingable between two opposite lateral positions, said pawl member comprising an engagement part with a means of engagement with said engagement member, and an actuating part comprising said first fixing point, and said spring means being further anchored in a second fixing point, connected to the said first handle, wherein the engagement member is defined by at least one row of teeth having an end stop at least one end;

a second end stop is provided adjacent the opposite end of said row of teeth;

the engagement part of the pawl member has two spacedly disposed engagement means for alternate engagement, in dependence on the present lateral position of the pawl member, with said engagement member, each of the said engagement means allowing a movement of the engagement member relative to the pawl member only in a direction opposite to the direction tolerated by the other engagement means, and each said engagement means being adapted to swing, upon impact with one of said end stops, the pawl member into its opposite lateral position.

12. The tool of claim 11, wherein said engagement part comprises two engagement arms having free ends which carry said engagement means and are located at different planes; said at least one row of teeth is thick so as to enable engagement of any said engagement means along a separate path adjacent the path of the other engagement means, and at least one of said end stops occupies only the space of one of the said two paths.

13. The tool of claim 11, wherein the at least one row of teeth is straight and at least one of said end stops is settable.

14. The tool of claim 11, wherein the at least one row of teeth is arcuate and disposed on a segment member.

15. The tool of claim 14, wherein the segment member is pivotally attached to both handles.

16. The tool of claim 14, wherein the segment member comprises two identical segment elements, each segment element carries a row of teeth with an end stop at one end, and both segment elements are rigidly mounted together with the end stops located at opposite ends.

17. The tool of claim 14, wherein the segment member comprises at least one segment element carrying a row of teeth but no end stop, and at least one segment element carrying at least one end stop but no row of teeth, and rigidly connected to the former at least one segment element.

18. The tool of claim 11, wherein the pawl member comprises two identical pawl elements with one engagement arm, both pawl elements being rigidly connected one with another with the engagement arms at opposite locations.

19. The tool of claim 11, wherein both engagement means lie in one plane and the row of teeth is extended relative a row of teeth in a corresponding mechanism with a pawl member having only one engagement means.

20. The tool of claim 11, wherein the said spring means is a leaf spring operating as a compression spring, and said first fixing point thereof is located at the rear end of the actuating part of the pawl member.

* * * * *